US009303955B2

(12) United States Patent
Jeung et al.

(10) Patent No.: US 9,303,955 B2
(45) Date of Patent: Apr. 5, 2016

(54) LOCKING MECHANISM FOR A SMALL ARM ACCESSORY

(71) Applicant: Bo Sun Jeung, Bucheon-si (KR)

(72) Inventors: Bo Sun Jeung, Bucheon-si (KR); In Jung, Bucheon-si (KR)

(73) Assignee: Bo Sun Jeung, Bucheon-si (KR)

( * ) Notice: Subject to any disclaimer, the term of this patent is extended or adjusted under 35 U.S.C. 154(b) by 5 days.

(21) Appl. No.: 14/221,472

(22) Filed: Mar. 21, 2014

(65) Prior Publication Data

US 2015/0268002 A1 Sep. 24, 2015

(51) Int. Cl.

| | |
|---|---|
| ***F41C 23/00*** | (2006.01) |
| ***F41G 11/00*** | (2006.01) |
| ***F41G 1/30*** | (2006.01) |

(52) U.S. Cl.

CPC ..... *F41G 11/003* (2013.01); *F41G 1/30* (2013.01); *Y10T 29/49826* (2015.01)

(58) Field of Classification Search

CPC ..... F41G 11/003; F41G 11/001; F41G 11/16; F41C 27/00; F41C 23/14; F41A 23/10

USPC ..... 42/71.02–73, 124–128

See application file for complete search history.

(56) References Cited

U.S. PATENT DOCUMENTS

| | | | | | |
|---|---|---|---|---|---|
| 1,816,195 | A * | 7/1931 | Redfield | | 42/127 |
| 1,837,290 | A * | 12/1931 | Redfield | | 42/127 |
| 1,856,549 | A * | 5/1932 | Griffin et al. | | 42/127 |
| 2,079,266 | A * | 5/1937 | Vaver | | 42/148 |
| 2,202,000 | A * | 5/1940 | Gray | F41G 11/003 | 42/124 |
| 3,365,801 | A * | 1/1968 | Simone, Jr. | F41G 1/38 | 42/124 |
| 3,734,437 | A * | 5/1973 | Underwood | | 248/205.1 |
| 3,750,318 | A * | 8/1973 | Burris | | 42/127 |
| 3,877,166 | A * | 4/1975 | Ward | | 42/127 |
| 4,310,980 | A * | 1/1982 | Pilkington | | 42/127 |
| 4,606,131 | A * | 8/1986 | Domian | | 42/137 |
| 4,628,611 | A * | 12/1986 | Ruffino | | 42/137 |
| 5,086,566 | A * | 2/1992 | Klumpp | | 42/126 |
| 8,397,421 | B2 * | 3/2013 | Ding et al. | | 42/124 |
| 2007/0068058 | A1 * | 3/2007 | Remo | | 42/122 |
| 2009/0038201 | A1 * | 2/2009 | Cheng et al. | | 42/127 |
| 2011/0283590 | A1 * | 11/2011 | Chiang | | 42/124 |

* cited by examiner

*Primary Examiner* — Samir Abdosh
(74) *Attorney, Agent, or Firm* — Baker & McKenzie LLP

(57) ABSTRACT

A fixing mechanism includes a mounting plate of a small arm accessory, a fixing member and an adjusting member. The mounting plate has a surface that faces the small arm when the mounting plate is fixed to the small arm. A first direction is defined as normal to the surface. The fixing member extends from the surface of the mounting plate in the first direction. The fixing member includes an aperture defined therein having an axis that defines a second direction different from the first direction. The adjusting member provides a fixing force to fix the small arm accessory to the small arm when inserted into the aperture of the fixing member.

30 Claims, 6 Drawing Sheets

LOCKING MECHANISM FOR A SMALL ARM ACCESSORY

BACKGROUND

The present disclosure relates to a dot sighting device for use in a small arm such as a handgun, a pistol, or a rifle, and more particularly, to a dot sight device for use in a small arm with a fixing mechanism conveniently attachable to or detachable from a small arm.

In recent years, dot sight devices have been employed in small arms. Using the dot sight device, since a user can aim at a target by simply causing a dot reticle image reflected from a reflective mirror to be aligned with the target, a time required to aim at the target is reduced, and it is possible to cope with an urgent situation rapidly.

FIG. 1 is a diagram illustrating a fixing mechanism of a dot sight device for use in a small arm according to a related art. In the fixing mechanism, a fixing protrusion 12 is formed on the bottom of a fixing plate 11, and the fixing protrusion 12 is fixed to a fixing groove 21 having a trapezoidal cross section formed on the rear end of a slide 20 of a small arm in a dovetail manner.

A housing 30 is arranged on the fixing plate 11 and screw-coupled with the fixing plate 11 engaged with the fixing groove 21 through a screw 7. As the screw 7 is fastened downwards, the fixing protrusion 12 is pushed upwards, so that the dot sight device is firmly fixed to the small arm.

In the fixing mechanism illustrated in FIG. 1, since the screw 7 is vertically inserted to couple the housing 30 with the slide 20, there is a limitation to the layout for arranging a battery, an electronic circuit substrate, a dot reticle image generating unit, and an adjusting knob, and the like which are arranged in the housing 30, and the size of the dot sight device increases as well.

Further, in the fixing mechanism illustrated in FIG. 1, when the dot sight device is configured with a plurality of plates which are vertically stacked, since an upper plate is coupled with a lower plate after the lower plate is fixed to the slide in a state in which the upper plate is removed, an assembly process is complicated.

Furthermore, the fixing protrusion 12 is integrally formed on the lower plate of the dot sight device. However, since the size of the fixing groove 21 formed on the rear end of the slide differs according to a type of small arm, there is a problem in that types of applicable small arms are limited, and compatibility is low.

BRIEF SUMMARY

In an embodiment, a fixing mechanism includes a mounting plate of a small arm accessory, a fixing member and an adjusting member. The mounting plate has a surface that faces the small arm when the mounting plate is fixed to the small arm. A first direction is defined as normal to the surface. The fixing member extends from the surface of the mounting plate in the first direction. The fixing member includes an aperture defined therein having an axis that defines a second direction different from the first direction. The adjusting member provides a fixing force to fix the small arm accessory to the small arm when inserted into the aperture of the fixing member.

The fixing member may expand when the adjusting member is inserted into the aperture.

The aperture may reduce in size in the second direction thereby causing the fixing member to expand when the adjusting member is inserted into the aperture.

The adjusting member may increase in size along its length thereby causing the fixing member to expand when the adjusting member is inserted into the aperture.

The cross-section of the fixing member may be trapezoidal.

The fixing mechanism may include a second adjusting member.

The aperture of the fixing member may be a through hole. The second adjusting member may insert into the through hole at an opposite side from the adjusting member to provide a fixing force to fix the small arm accessory to the small arm.

The fixing member may include a second aperture defined therein at a side opposing the first aperture and having an axis in the second direction. The second adjusting member may insert into the second aperture of the fixing member to provide a fixing force to fix the small arm accessory to the small arm.

The mounting plate may include a protrusion extending in the first direction. The protrusion may include a through hole having an axis in the second direction. The fixing member may be distinct from the mounting plate. The adjusting member may insert through the through-hole of the protrusion and into the aperture of the fixing member.

The fixing member may include a plurality of grooves along an exterior surface thereby defining a plurality of contact plates.

At least one of the contact plates may come into contact with the small arm when a lateral force is applied to the adjusting member.

The fixing mechanism may include a pivot shaft and a pivot plate. The fixing member may include a second aperture defined therein having an axis in the first direction. The pivot shaft and the pivot plate may be disposed in the second aperture. The adjusting member may the pivot plate to rotate about the pivot shaft inserted into the aperture of the fixing member.

The aperture of the fixing member may be threaded.

The small arm accessory may be a dot sighting device.

The first and second directions may be orthogonal.

In another embodiment, a small arm accessory system includes a small arm and a small arm accessory. The small arm includes a barrel and a mounting groove defined in the small arm. A central axis of the barrel defines a first direction. A second direction is defined as orthogonal to the first direction. A major axis of the mounting groove is oriented in a third direction different from the first and second directions. The small arm accessory includes a mounting plate, a fixing member and an adjusting member. The mounting plate includes a surface that faces the small arm when the mounting plate is fixed to the small arm. The fixing member extends from the surface of the mounting plate in the second direction. The fixing member includes an aperture defined therein having an axis in the third direction. The adjusting member provides a fixing force to fix the small arm accessory to the small arm when inserted into the aperture of the fixing member.

A cross-sectional shape of the fixing member may be complimentary to and smaller than a cross-sectional shape of the mounting groove.

The cross-sectional shape may be trapezoidal.

The fixing member may expand when the adjusting member is inserted into the aperture.

The mounting plate may include a protrusion extending in the second direction. The protrusion may include a through hole having an axis in the third direction. The fixing member may be distinct from the mounting plate. The adjusting member may insert through the through-hole of the protrusion and into the aperture of the fixing member.

The fixing member may include a plurality of grooves along an exterior surface thereby defining a plurality of contact plates. At least one of the contact plates may come into contact with the small arm when a lateral force is applied to the adjusting member.

The small arm accessory may include includes a pivot shaft and a pivot plate. The fixing member may include a second aperture defined therein having an axis in the first direction. The pivot shaft and the pivot plate may be disposed in the second aperture. The adjusting member may cause the pivot plate to rotate about the pivot shaft inserted into the aperture of the fixing member.

In another embodiment, a method for fixing a small arm accessory to a small arm includes: providing a small arm having a mounting groove extending in a lateral direction; providing a small arm accessory having a fixing member that slides in the mounting grove of the small arm, the fixing member having an aperture defined therein in the lateral direction; sliding the fixing member in the mounting groove; inserting, laterally, an adjusting member into the aperture; applying a lateral force to the adjusting member to fix the small arm accessory to the small arm.

The adjusting member may be threaded and the lateral force may be applied by rotating the adjusting member to drive the adjusting member inward in the lateral direction.

The fixing member may expand when the lateral force is applied.

The mounting plate may include a protrusion having a through hole with an axis in the lateral direction. The fixing member may be distinct from the mounting plate. The adjusting member may be inserted through the through-hole of the protrusion and into the aperture of the fixing member.

The fixing member may include a plurality of grooves along an exterior surface thereby defining a plurality of contact plates. Applying the lateral force may cause at least one of the contact plates to come into contact with the mounting groove of the small arm.

The small arm accessory may include a pivot shaft and a pivot plate. The fixing member may include a second aperture defined therein having an axis orthogonal to the lateral direction. The pivot shaft and the pivot plate are disposed in the second aperture. The applying the lateral force may cause the pivot plate to rotate about the pivot shaft.

A width of the pivot plate may be less than a width of the aperture and greater than a width of the mounting groove.

DETAILED DESCRIPTION

It is desirable to provide a dot sight device for use in a small arm with a fixing mechanism conveniently attachable to or detachable from a small arm. It is also desirable to provide a compact dot sight device for use in a small arm with a compact side fixing mechanism.

It is also desirable to provide a dot sight device for use in a small arm which is compatible with various types of small arms having different sizes of fixing grooves.

According to the exemplary embodiments, it is possible to provide a dot sight device for use in a small arm with a fixing mechanism conveniently attachable to or detachable from a small arm. Further, it is possible to provide a compact dot sight device for use in a small arm with a compact fixing mechanism in which a fixing screw is laterally inserted into a fixing groove.

Furthermore, it is possible to provide a dot sight device for use in a small arm which is compatible with various types of small arms having different sizes of fixing grooves.

Hereinafter, exemplary embodiment of the present disclosure will be described in detail with reference to the appended drawings.

First, a dot sight device for use in a small arm with a fixing mechanism according to a first embodiment of the present invention will be described in detail with reference to the appended drawings.

Figure 1:
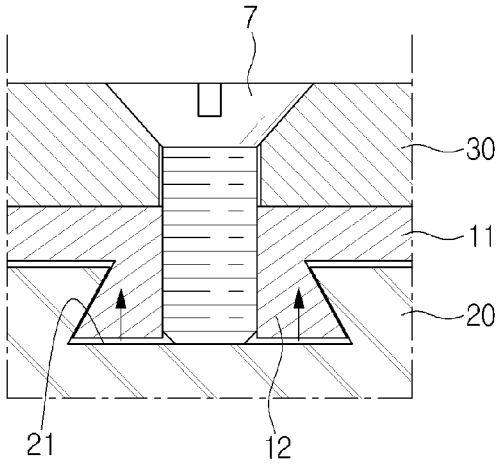
RELATED ART FIGURE 1
FIG. 1 is a diagram illustrating a fixing mechanism of a dot sight device for use in a small arm according to a related art.
Figure 2:
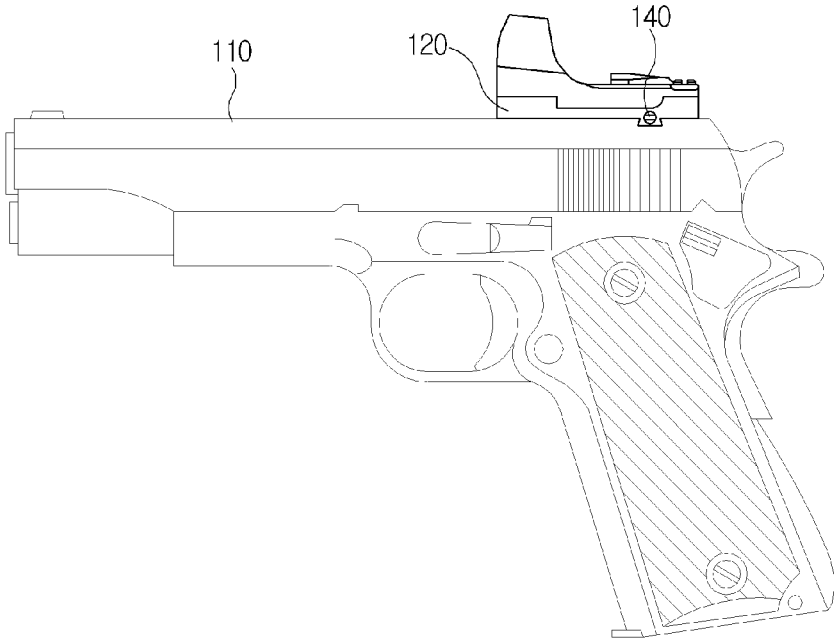
FIG. 2 is a diagram illustrating a dot sight device for use in a small arm with a fixing mechanism according to an embodiment of the present disclosure.

FIG. 2 is a diagram illustrating a dot sight device for use in a small arm with a fixing mechanism according to an embodiment of the present disclosure. A dot sight device according to the present disclosure includes a light-emitting device (LED or a laser diode (LD)) configured to emit light as a light source, a reflector configured to reflect beams emitted from the light-emitting device toward an observer (user), and a fixing mechanism configured to provide a structure easily attachable to or detachable from a small arm such as a handgun, a pistol, or a rifle. The dot sight device further includes an upper plate (not shown) and a lower plate 120. Further, a battery, an electronic circuit substrate, and the like are arranged between the upper plate and the lower plate 120. Generally, the reflector is arranged on the upper plate, and the fixing mechanism is arranged on the lower plate. The following description will proceed with the example in which the fixing mechanism is arranged on the lower plate. However, the present disclosure is not limited to the example in which the fixing mechanism is arranged on the lower plate.

Figure 3:
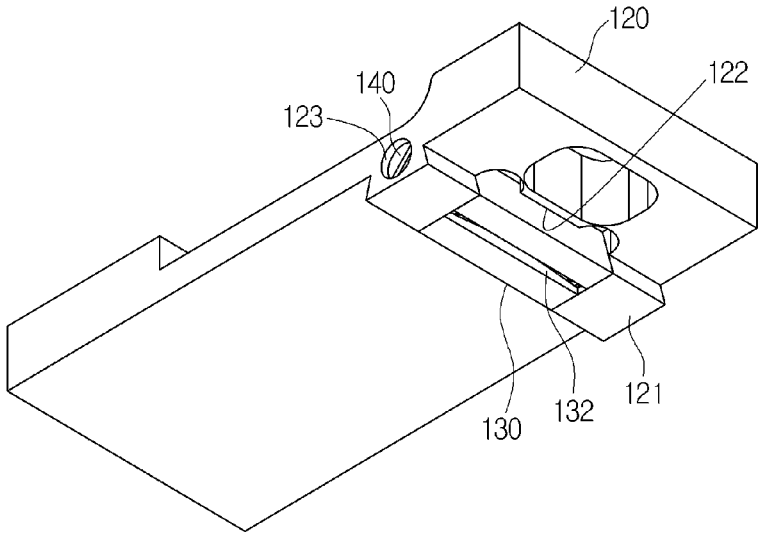
FIG. 3 is a perspective view illustrating a fixing mechanism according to a first embodiment of the present disclosure.
Figure 4:
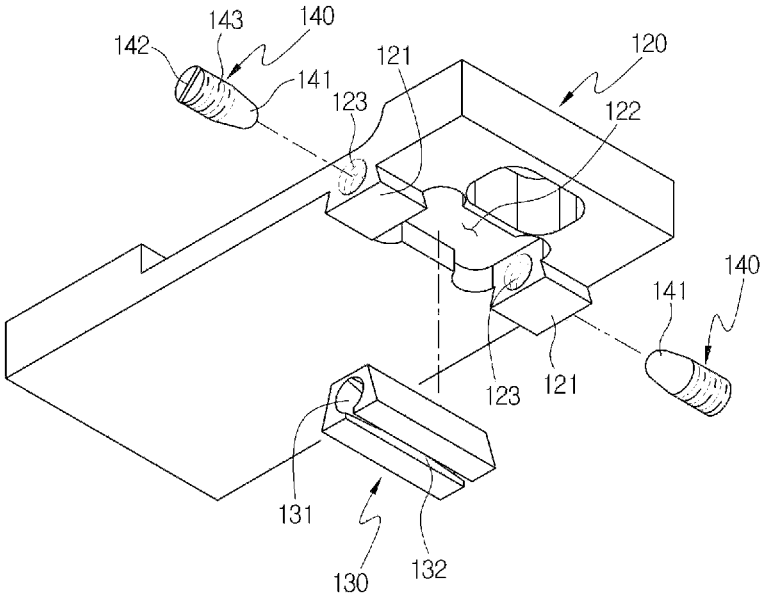
FIG. 4 is an exploded perspective view illustrating the fixing mechanism according to the first embodiment of the present disclosure.

FIG. 3 is a perspective view illustrating the fixing mechanism according to the first embodiment of the present embodiment, and FIG. 4 is an exploded perspective view illustrating the fixing mechanism according to the first embodiment of the present embodiment. The fixing mechanism of the present disclosure includes a fixing protrusion 121, an accommodation groove 122, a fixing member 130, and an adjusting member 140. The fixing protrusion 121 may be formed integrally with the lower plate 120 of the dot sight device. The fixing protrusion 121 includes a coupling hole 123 that may have a female screw or an internal thread. The fixing protrusion 121 may have a cross section corresponding to that of the fixing member 130. In this example, the fixing protrusion 121 may have a trapezoidal cross section. The accommodation groove 122 is formed on the lower plate 120 of the dot sight device between both ends the fixing protrusion 121 in the form of a recess. The accommodation groove 122 is provided in a form in which fixing members 130 of various shapes or sizes can be accommodated. The accommodation groove 122 has an internal circumferential surface that is obliquely formed so that the fixing member 130 can expand or contract. The fixing member 130 has a shape corresponding to a fixing groove 111 (see FIG. 6) formed in a small arm slide 110. In this example, the fixing member 130 has a bar shape having a trapezoidal cross section. The fixing member 130 includes an insertion hole 131 and a slot 132. The fixing member 130 is placed on the accommodation groove 122 between both ends of the fixing protrusion 121. The fixing member 130 is made of an expansible or contractible material. The fixing member 130 is expansible or contractible. In other words, as the adjusting member 140 is inserted toward the center of the insertion hole 131 of the fixing member 130 through the coupling hole 123 in a state in which the fixing member 130 is paced on the accommodation groove 122, the width of the slot 132 gradually increases, and thus the fixing member 130, that is, the insertion hole 131 gradually expands. Further, as the adjusting member 140 moves back from the center of the insertion hole 131 of the fixing member 130, the width of the slot 132 gradually decreases, and thus the fixing member 130, that is, the insertion hole 131 gradually contracts. A plurality of fixing members 130 having different sizes may be prepared to support various kinds of small arms. In other words, a plurality of fixing members 130 having various sizes can be prepared, and among the plurality of fixing members 130, the fixing member 130 corresponding to the size of the fixing groove 111 (see FIG. 6) can be selected and used. The adjusting member 140 includes a leading end 141, a body portion 143, and a head portion 142. The leading end 141 is formed such that the diameter thereof gradually increases toward the body portion 143. Thus, as the adjusting member 140 is inserted toward the center of the fixing member 130, the leading end 141 provides the fixing member 130 with expansion force causing the fixing member 130 to expand. The diameter of the tip of the leading end 141 may be smaller than the diameter of the insertion hole 131 in the contracted state, and the diameter of the portion of the leading end 141 near the body portion 143, that is, the diameter of the body portion 143 is larger than the diameter of the insertion hole 131 in the contracted state. For example, the leading end 141 can have various shapes such as a conical shape, a conical shape having a rounded tip, a poly prism shape, a poly prism shape having a rounded tip, or the like. The body portion 143 has a male screw or an external thread on an outer circumferential surface thereof, corresponding to the female screw of the coupling hole 123. The adjusting member 140 is screw-coupled with the fixing protrusion 121 when the dot sight device is fixed to the small arm. The head portion 142 is formed on the head of the adjusting member 140. The head portion 142 is used to rotate the adjusting member 140 and fasten or release the adjusting member 140 using, for example, a screw driver. To this end, the head portion 142 has a slot, a groove, or a recess corresponding to a tip of a tool used to turn the adjusting member 140 such as a screwdriver. The head portion 142 can have slots, grooves, or recesses of various forms such as a straight line form, a cross from, or a polygonal from. In this example, the head portion 142 has a slot of a straight line. In this example, the two adjusting members 142 are provided, and laterally inserted into the insertion holes 132 while providing the fixing member 130 with expansion force from both sides. However, the present disclosure is not limited to this example, and the number of adjusting members 142 may be one or three or more. For example, a single adjusting member 142 may be provided as long as expansion force enough to stably fix the dot sight device to the small arm is provided. The fixing mechanism fixes the dot sight device 120 to the small arm slide 110 such that the fixing protrusion 121 is coupled with the fixing member 130 using the adjusting members 140, and the fixing member 130 is coupled with the fixing groove 111 (see FIG. 6) in the dovetail manner.

Next, a process of fixing the dot sight device to the small arm through the fixing mechanism according to the first embodiment of the present disclosure will be described with reference to FIGS. 5 to 8.

Figure 5:
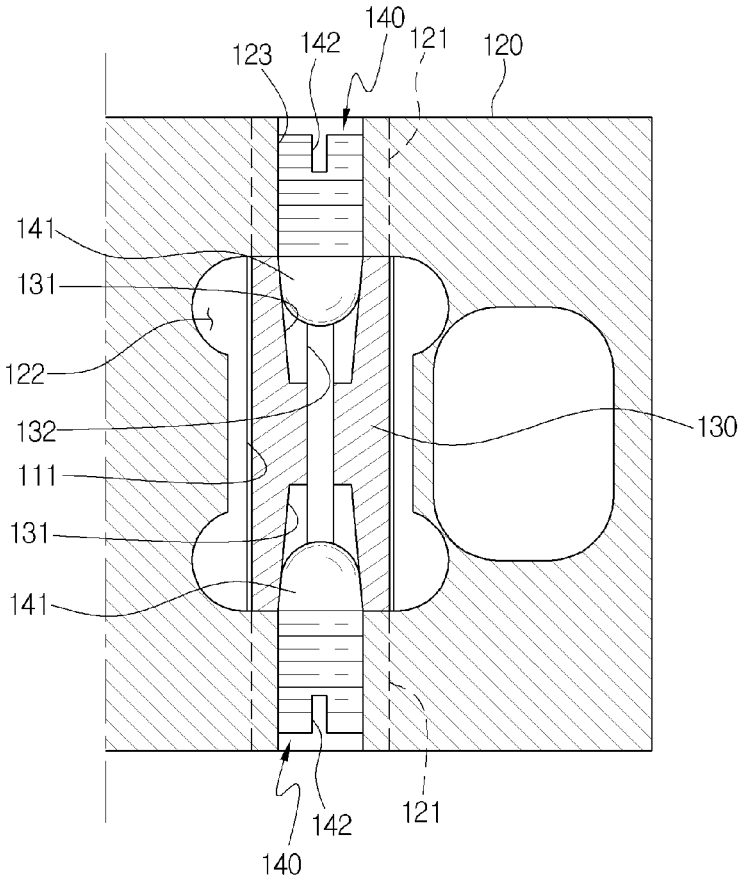
FIG. 5 is a plane view illustrating the fixing mechanism according to the first embodiment of the present disclosure.
Figure 6:
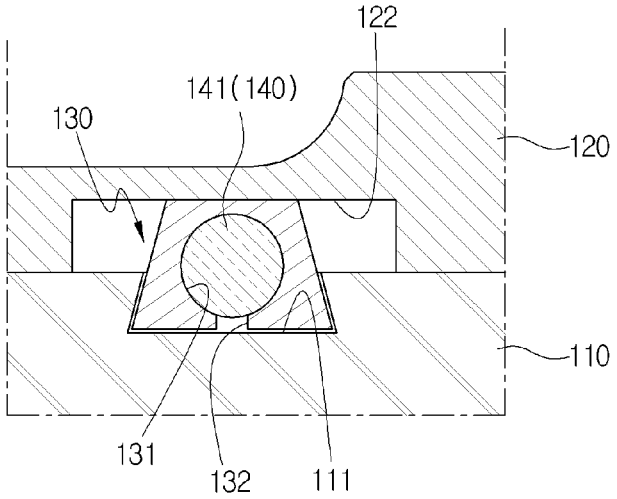
FIG. 6 is a cross-sectional view illustrating the fixing mechanism according to the first embodiment of the present disclosure.
Figure 7:
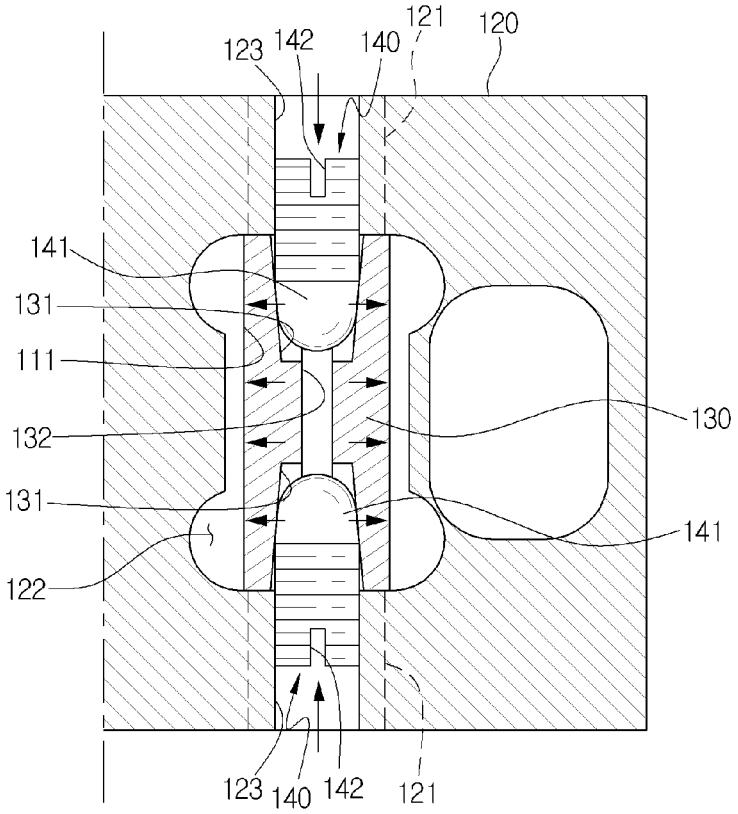
FIGS. 7 and 8 are cross sectional views of fixing a dot sight device to a small arm through the fixing mechanism according to the first embodiment of the present disclosure.
Figure 8:
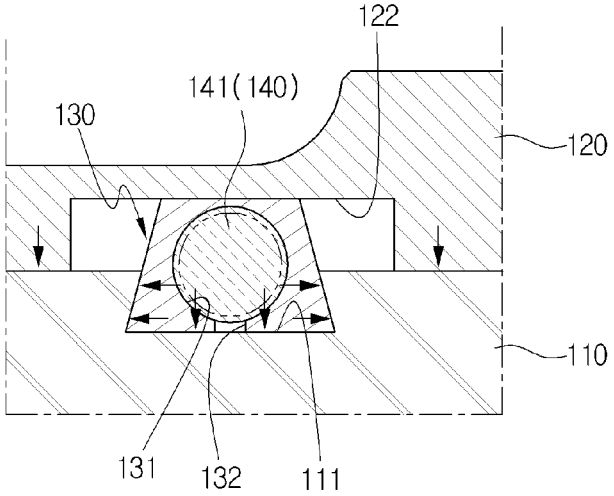

FIG. 5 is a plane view illustrating the fixing mechanism according to the first embodiment of the present disclosure, FIG. 6 is a cross-sectional view illustrating the fixing mechanism according to the first embodiment of the present disclosure, and FIGS. 7 and 8 are explanatory views for describing the process of fixing the dot sight device to the small arm through the fixing mechanism according to the first embodiment of the present disclosure.

As illustrated in FIGS. 5 and 6, first, a fixing member 130 corresponding to a desired small arm is selected among a plurality of fixing members 130 which are prepared in advance, and placed on the accommodation groove 122 between both ends of the fixing protrusion 121 so that the coupling hole 123 is aligned with the insertion hole 131.

The two adjusting members 140 are inserted into the insertion hole 131 of the fixing member 130 while screw-coupling with the coupling holes 123, and thus the fixing member 130 is assembled with the lower plate 120 of the dot sight device through the fixing protrusion 121.

In a state in which the adjusting member 140 does not provide expansion force to the fixing member 130, the fixing member 130 is coupled with the fixing groove 111 of the small arm slide 110 of the small arm in the dovetail manner. Then, as illustrated in FIGS. 7 and 8, when the two adjusting members 140 are further fastened to move forward the center of the fixing member 130 from both sides of the fixing protrusion 121 in this state, the leading ends 141 of the two adjusting members 140 push the inner walls of the insertion holes 131, and thus expansion force is applied to the fixing member 130 in a direction perpendicular to a longitudinal direction of the fixing member since the slot 132 is formed in the fixing member 130. As the fixing member 130 expands centering on the slot 132, the outer surface of the fixing member 130 pushes the inner surface of the fixing groove 111 of the small arm slide 110, so that the dot sight device is firmly fixed to the small arm.

More specifically, when the adjusting members 140 are rotated and fastened in the state in which the leading ends 141 of the adjusting members 140 are laterally inserted into the insertion hole 131 of the fixing member 130, the leading ends 141 of the adjusting members 140 move forward in the insertion hole 131 while coming into point contact or line contact with the inner surface of the insertion hole 131, and thus the fixing member 130 expands centering on the slot 132 to push the inner walls of the fixing groove 111 and comes into close contact with the fixing groove 111. Accordingly, the dot sight device may be firmly fixed to the small arm.

Here, as illustrated in FIG. 7, at least one of both ends of the insertion hole 131 may have a shape corresponding to the shape of the leading end of the leading end 141 of the adjusting member 140. In other words, at least one of both ends of the insertion hole 131 may have the diameter that gradually decreases toward the inside thereof. However, the present disclosure is not limited to this example. For example, both ends of the insertion hole 131 may have a shape having a constant diameter.

When both ends of the insertion hole 131 have the diameter that gradually decreases toward the inside thereof corresponding to the leading end 141 of the adjusting member 140, the leading end 141 of the adjusting member 140 comes into surface contact with the insertion hole 131 of the fixing member 130, the leading end 141 uniformly pushes the inner surface of the insertion hole 131 by the leading end 141, and thus expansion force of the fixing member 130 is uniformly applied to the inner wall of the fixing groove 111.

At this time, since the fixing member 130 has a shape corresponding to the fixing groove 111 as illustrated in FIG. 8, as the fixing member 130 expands as indicated by arrows in the state in which the fixing member 130 is fitted into the fixing groove 111, both the outer walls of the fixing member 130 come into close contact with both inner walls of the fixing groove 111, and the bottom surface of the fixing member 130 come into close contact with the bottom surface of the fixing groove 111.

In other words, since the fixing member 130 pushes the inner walls and the bottom surface of the fixing groove 111 while coming into close contact with the fixing groove 111 as indicated by arrows in FIG. 8, the dot sight device may be firmly fixed to the small arm.

In addition, since the fixing member 130 is coupled with the fixing protrusion 121 through the adjusting member 140, force of the fixing member 130 pushing the bottom surface of the fixing groove 111 is transferred to the lower plate 120, that is, the dot sight device, and thus fixing force between the lower plate 120 of the dot sight device 120 and the small arm slide 110 increases.

Meanwhile, the dot sight device can be conveniently detached from the small arm by simply rotating and loosening the adjusting member 140. Specifically, as the adjusting member 140 is rotated and loosened, the leading end 141 of the adjusting member 140 moves back from the insertion hole 131, the fixing member 130 contracts, and thus the outer walls of the fixing member 130 come apart from the inner walls of the fixing groove 111. Then, since no fixing force is applied between the fixing member 130 and the fixing groove 111, the user can easily take the dot sight device from the fixing groove 111 of the small arm while pulling or pushing the dot sight device in the longitudinal direction of the fixing groove 111.

In addition, since the fixing member 130 can be selected from the plurality of fixing members 130 having the different sizes, the fixing mechanism according to the present disclosure is compatible with various forms of small arms.

Figure 9:
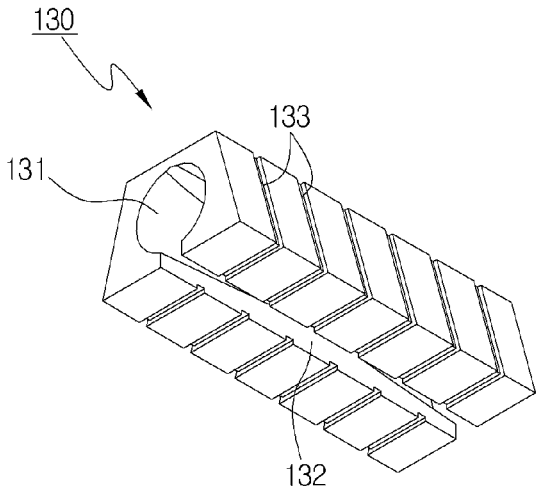
FIG. 9 is a perspective view illustrating a modification of the fixing member according to the first embodiment of the present disclosure.

FIG. 9 is a perspective view illustrating a modification of the fixing member 130. Referring to FIG. 9, the fixing member 130 includes concave-convex portions 133 which are formed in the form of a groove or a protrusion extending in the direction perpendicular to the longitudinal direction of the fixing member 130 on the outer circumferential surface of the fixing member 130. The concave-convex portions (for example, a groove or ridge) 133 serve to increase friction force between the fixing member 130 and the fixing groove 111. In other words, since the concave-convex portions 133 are formed in the direction perpendicular to the moving direction of the fixing member 130, frictional force making it difficult for the fixing member 130 to move in the longitudinal direction of the fixing member 130 increases in a state in which the fixing member 130 expands toward the inner wall of the fixing groove 111 and comes into close contact with the fixing groove 111. Thus, sufficient fixing force may be provided although the adjusting member 140 is not excessively fastened. As described above, according to the first embodiment of the present disclosure, it is possible to conveniently attach or detach the dot sight device to or from the small arm, the dot sight device is compatible with various forms of small arms, and the compact dot sight device can be provided due to the side fixing mechanism.

Next, a dot sight device for use in a small arm with a fixing mechanism according to a second embodiment of the present disclosure will be described.

Figure 10:
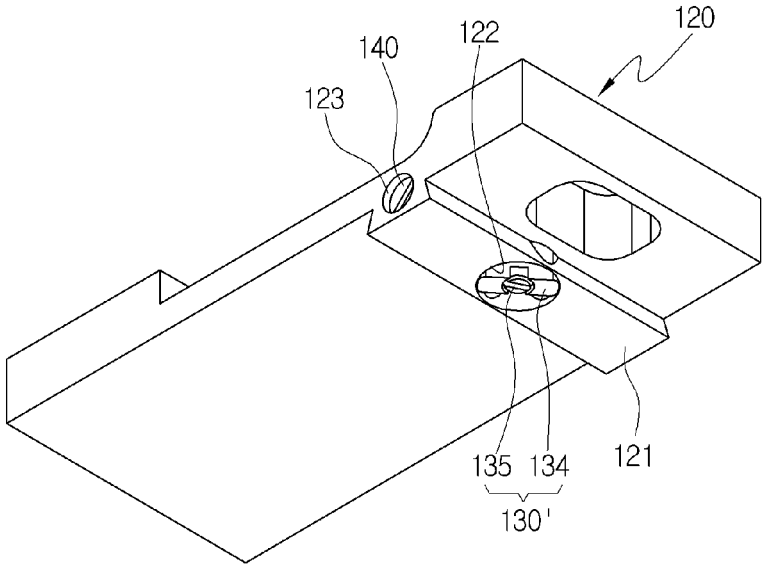
FIG. 10 is a perspective view illustrating a dot sight device for use in a small arm with a fixing mechanism according to a second embodiment of the present disclosure.
Figure 11:
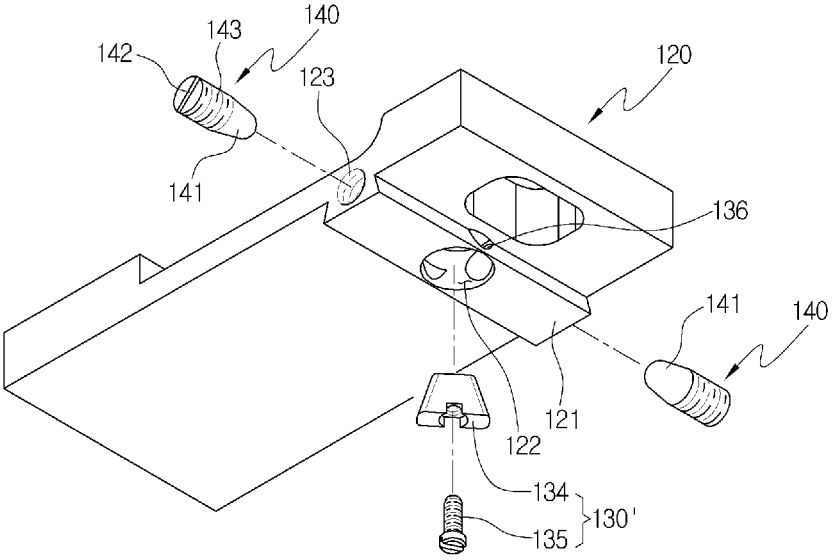
FIG. 11 is an exploded perspective view illustrating the dot sight device for use in a small arm with a fixing mechanism according to the second embodiment of the present disclosure.
Figure 12:
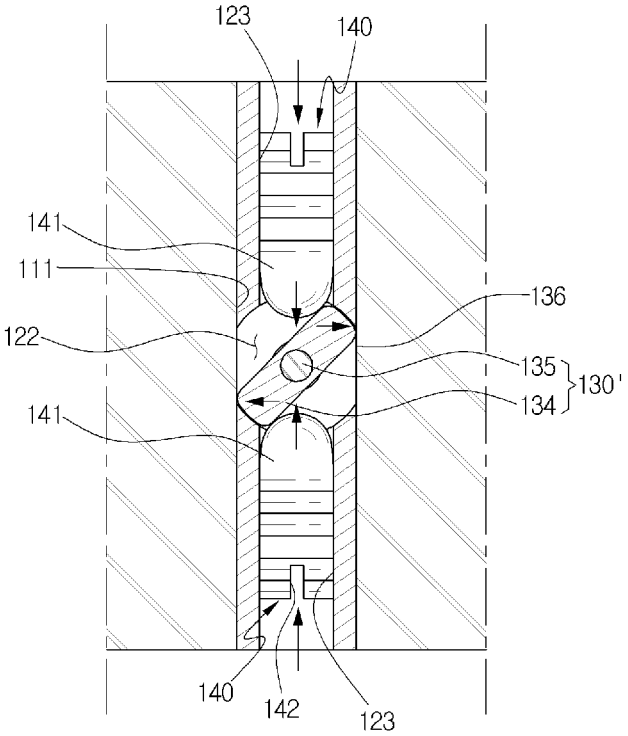
FIG. 12 is a cross sectional view illustrating a state in which the dot sight device for use in a small arm with the fixing mechanism according to the second embodiment of the present disclosure is fixed.

FIG. 10 is a perspective view illustrating the dot sight device for use in a small arm with a fixing mechanism according to the second embodiment of the present disclosure, FIG. 11 is an exploded perspective view illustrating the dot sight device for use in a small arm with a fixing mechanism according to the second embodiment of the present disclosure, and FIG. 12 is a cross sectional view illustrating a state in which the dot sight device for use in a small arm with a fixing mechanism according to the second embodiment of the present disclosure is fixed.

The difference with the dot sight device for use in a small arm with a fixing mechanism according to the second embodiment of the present disclosure lies in that a fixing member 130' is rotated as the adjusting member 140 is fastened and selectively comes into contact with both inner walls of the fixing groove 111, and an aperture 136 formed in the fixing protrusion 121. Description of structure that is common with the first embodiment is omitted for brevity.

The fixing member 130' includes a shaft 135 which is vertically coupled with the accommodation groove 122 and a pivot plate 134 which is placed on the accommodation groove 122 to pivot on the shaft 135. The shaft 135 may be provided by a screw secured to a screw formed in the fixing member 130' near a center of the aperture 136. The pivot plate 134 is coupled to the lower plate 120 of the dot sight device as the shaft 135 is screw-coupled with the lower plate 120. Further, the fixing protrusion 121 includes the aperture 136 defined therein. When the pivot plate 134 is pushed and rotated by the adjusting member 141, the aperture 136 serves to allow the fixing member 130' to come into contact with the fixing groove 111. The pivot plate 134 may be smaller than an opening of the aperture 136 to allow insertion into the aperture 136 and also larger than a width the fixing groove 111. Thus, when the pivot plate 134 is rotated about the shaft 135, the pivot plate comes into contact with the fixing groove 111 providing an interference fit. The pivot plate 134 has a trapezoidal shape, and the accommodation groove 122 has a conical shape corresponding to the trapezoidal shape of the pivot plate 134. But, the present disclosure is not limited to this example, and for example, the pivot plate 134 may have a rectangular shape, and the accommodation groove 122 may have a cylindrical shape corresponding to the rectangular shape of the pivot plate 134.

Specifically, as illustrated in FIG. 12, the fixing member 130' is placed on the accommodation groove 122 and coupled to the lower plate 120 by the shaft 135. Then, the dot sight device is fitted into the small arm slide in the dovetail manner. In this state, the adjusting member 140 is fastened to move forward, and pushes the fixing member 130'. The pivot plate 134 of the fixing member 130 pivots and comes into contact with the inner walls the fixing groove 111 through the aperture 136. Thus, the dot sight device is firmly fixed to the small arm.

As described above, according to the second embodiment of the present disclosure, it is possible to conveniently attach or detach the dot sight device to or from the small arm, the dot sight device is compatible with various forms of small arms, and the compact dot sight device having the side fixing mechanism can be provided.

While various embodiments of the disclosure have been described and illustrated above, it should be understood that these are exemplary of the invention and are not to be considered as limiting. Additions, omissions, substitutions, and other modifications can be made without departing from the spirit or scope of the present invention.

For example, in the structure illustrated in FIG. 4, the fixing member 130 may not be provided, and instead, the fixing protrusion 121 may have the function of the fixing member 130. Specifically, the fixing protrusion 121 may include a slot corresponding to the slot 132 of the fixing member 130, and an internal hole having the functions of both the coupling hole 123 and the insertion hole 131. In this case, as the adjusting members 140 are fastened and screw-coupled in a state in which the fixing protrusion 121 is fitted into the fixing groove 111, the fixing protrusion 121 expands so that the outer wall of the fixing protrusion 121 come into close contact with the inner walls of the fixing groove 111, and thus sufficient fixing forces is provided.

As another example, the fixing device may be used with other small arm accessories such as lights, optical sights, and laser sights.

Accordingly, the invention is not to be considered as being limited by the foregoing description, and is only limited by the scope of the claims. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A fixing mechanism, comprising:

a mounting plate of a small arm accessory having a surface that faces the small arm when the mounting plate is fixed to the small arm, a first direction being defined as normal to the surface;

a fixing member extending from the surface of the mounting plate in the first direction, the fixing member including an aperture defined therein having an axis that defines a second direction different from the first direction; and an adjusting member that when inserted into the aperture of the fixing member causes the fixing member to provide a fixing force to fix the small arm accessory to the small arm.

2. A fixing mechanism, comprising:

a mounting plate of a small arm accessory having a surface that faces the small arm when the mounting plate is fixed to the small arm, a first direction being defined as normal to the surface;

a fixing member extending from the surface of the mounting plate in the first direction, the fixing member including an aperture defined therein having an axis that defines a second direction different from the first direction; and an adjusting member that when inserted into the aperture of the fixing member provides a fixing force to fix the small arm accessory to the small arm, wherein the fixing member expands when the adjusting member is inserted into the aperture.

3. The fixing mechanism of claim 2, wherein the aperture reduces in size in the second direction thereby causing the fixing member to expand when the adjusting member is inserted into the aperture.

4. The fixing mechanism of claim 3, wherein the adjusting member increases in size along its length thereby causing the fixing member to expand when the adjusting member is inserted into the aperture.

5. The fixing mechanism of claim 1, wherein a cross-section of the fixing member is trapezoidal.

6. The fixing mechanism of claim 1, further comprising a second adjusting member.

7. The fixing mechanism of claim 6, wherein the aperture of the fixing member is a through hole, and the second adjusting member inserts into the through hole at an opposite side from the adjusting member to provide a fixing force to fix the small arm accessory to the small arm.

8. The fixing mechanism of claim 6, wherein the fixing member includes a second aperture defined therein at a side opposing the first aperture and having an axis in the second direction, and the second adjusting member inserts into the second aperture of the fixing member to provide a fixing force to fix the small arm accessory to the small arm.

9. The fixing mechanism of claim 1, wherein the mounting plate includes a protrusion extending in the first direction, the protrusion includes a through hole having an axis in the second direction, the fixing member is distinct from the mounting plate, and the adjusting member inserts through the through-hole of the protrusion and into the aperture of the fixing member.

10. The fixing mechanism of claim 1, wherein the fixing member includes a plurality of grooves along an exterior surface thereby defining a plurality of contact plates.

11. The fixing mechanism of claim 10, wherein at least one of the contact plates comes into contact with the small arm when a lateral force is applied to the adjusting member.

12. The fixing mechanism of claim 1, wherein the aperture of the fixing member is threaded.

13. The fixing mechanism of claim 1, wherein the small arm accessory is a dot sighting device.

14. The fixing mechanism of claim 1, wherein the first and second directions are orthogonal.

15. A small arm accessory system, comprising:

a small arm having a barrel and a mounting groove defined in the small arm, a central axis of the barrel defining a first direction, a second direction being defined as orthogonal to the first direction, and a major axis of the mounting groove being oriented in a third direction different from the first and second directions;

a small arm accessory including:

a mounting plate having a surface that faces the small arm when the mounting plate is fixed to the small arm;

a fixing member extending from the surface of the mounting plate in the second direction, the fixing member including an aperture defined therein having an axis in the third direction; and an adjusting member that when inserted into the aperture of the fixing member provides a fixing force to fix the small arm accessory to the small arm.

16. The small arm accessory system of claim 15, wherein a cross-sectional shape of the fixing member is complimentary to and smaller than a cross-sectional shape of the mounting groove.

17. The small arm accessory system of claim 16, wherein the cross-sectional shape is trapezoidal.

18. The small arm accessory system of claim 15, wherein the fixing member expands when the adjusting member is inserted into the aperture.

19. The small arm accessory system of claim 15, wherein the mounting plate includes a protrusion extending in the second direction, the protrusion includes a through hole having an axis in the third direction, the fixing member is distinct from the mounting plate, and the adjusting member inserts through the through-hole of the protrusion and into the aperture of the fixing member.

20. The small arm accessory system of claim 15, wherein the fixing member includes a plurality of grooves along an exterior surface thereby defining a plurality of contact plates, and at least one of the contact plates comes into contact with the small arm when a lateral force is applied to the adjusting member.

21. A method for fixing a small arm accessory to a small arm, comprising:

providing a small arm having a mounting groove extending in a lateral direction, the lateral direction being defined as a different direction than a central axis of a barrel of the small arm;

providing a small arm accessory having a fixing member that slides in the mounting groove of the small arm, the fixing member having an aperture defined therein in the lateral direction;

sliding the fixing member in the mounting groove;

inserting, laterally, an adjusting member into the aperture;

applying a lateral force to the adjusting member to fix the small arm accessory to the small arm.

22. The method of claim 21, wherein the adjusting member is threaded and the lateral force is applied by rotating the adjusting member to drive the adjusting member inward in the lateral direction.

23. The method of claim 21, wherein the fixing member expands when the lateral force is applied.

24. The method of claim 21, wherein the mounting plate includes a protrusion having a through hole with an axis in the lateral direction, the fixing member is distinct from the mounting plate, and the adjusting member is inserted through the through-hole of the protrusion and into the aperture of the fixing member.

25. The method of claim 21, wherein the fixing member includes a plurality of grooves along an exterior surface thereby defining a plurality of contact plates, and the applying the lateral force causes at least one of the contact plates to come into contact with the mounting groove of the small arm.

26. A fixing mechanism, comprising:

a mounting plate of a small arm accessory having a surface that faces the small arm when the mounting plate is fixed to the small arm, a first direction being defined as normal to the surface;

a fixing member extending from the surface of the mounting plate in the first direction, the fixing member including an aperture defined therein having an axis that defines a second direction different from the first direction; and an adjusting member that when inserted into the aperture of the fixing member provides a fixing force to fix the small arm accessory to the small arm, wherein the fixing member is distinct from the mounting plate.

27. The fixing mechanism of claim 1, further comprising:

a pivot shaft; and a pivot plate, wherein the fixing member includes a second aperture defined therein having an axis in the first direction, the pivot shaft and the pivot plate are disposed in the second aperture, and the adjusting member causes the pivot plate to rotate about the pivot shaft inserted into the aperture of the fixing member.

28. The small arm accessory system of claim 15, wherein the small arm accessory includes a pivot shaft and a pivot plate, the fixing member includes a second aperture defined therein having an axis in the first direction, the pivot shaft and the pivot plate are disposed in the second aperture, and the adjusting member causes the pivot plate to rotate about the pivot shaft inserted into the aperture of the fixing member.

29. The method of claim 21, wherein the small arm accessory includes a pivot shaft and a pivot plate, the fixing member includes a second aperture defined therein having an axis orthogonal to the lateral direction, the pivot shaft and the pivot plate are disposed in the second aperture, and the applying the lateral force causes the pivot plate to rotate about the pivot shaft.

30. The method of claim 29, wherein a width of the pivot plate is less than a width of the aperture and greater than a width of the mounting groove.

* * * * *